United States Patent [19]

LaBate

[11] 4,372,544

[45] Feb. 8, 1983

[54] BLAST FURNACE TROUGH AND LINER COMBINATION

[76] Inventor: Michael D. LaBate, 115 Hazen Ave., Ellwood City, Pa. 16117

[21] Appl. No.: 261,678

[22] Filed: May 7, 1981

[51] Int. Cl.[3] ..... C21B 3/00

[52] U.S. Cl. ..... 266/281; 266/196

[58] Field of Search ..... 266/196, 275, 280, 281, 266/283, 284, 286; 249/200, 201, 199

[56] References Cited

U.S. PATENT DOCUMENTS

| | | | |
|---|---|---|---|
| 1,681,943 | 8/1928 | Marshall | 266/280 |
| 3,203,689 | 8/1963 | Hallowell, Jr. | 266/281 X |
| 3,212,749 | 10/1965 | LaBate | 249/200 |
| 3,955,721 | 5/1976 | LaBate | 266/280 X |
| 4,012,029 | 3/1977 | Sequin et al. | 266/281 |
| 4,194,730 | 3/1980 | Matsumoto et al. | 266/275 |

FOREIGN PATENT DOCUMENTS

| | | | |
|---|---|---|---|
| 1506506 | 5/1978 | United Kingdom | 266/280 |

*Primary Examiner*—L. Dewayne Rutledge
*Assistant Examiner*—David Hey
*Attorney, Agent, or Firm*—Harpman & Harpman

[57] ABSTRACT

A blast furnace trough and liner for transferring molten metal from a blast furnace or the like to a hot metal runner or the like comprises a metal trough with an expendable one-piece prefabricated liner therein, the liner being formed of refractory based materials in several layers of different densities coalesced by physical force.

10 Claims, 4 Drawing Figures

BLAST FURNACE TROUGH AND LINER COMBINATION

BACKGROUND OF THE INVENTION (1) Technical Field

This invention relates to blast furnace troughs which are intermediate vessels into which molten metal is poured and from which the molten metal is transferred to hot metal runners or continuous casters. The trough allows some of the undesirable non-metallic inclusions to separate from the hot metal. The use of a trough reduces splashing and allows better control of the pouring rate.

(2) Description of the Prior Art

The known similar prior art devices comprise tundish boxes and hot metal ladles which are usually open topped metal vessels with refractory brick linings. The tundish boxes have one or more pouring nozzles therein and the ladles have pouring spouts. See for example U.S. Pat. Nos. 3,203,689 and 1,681,943.

In Pat. No. 1,681,943 a ladle lining is disclosed wherein the lining is formed of a one-piece body placed directly against the inner surface of the metal ladle.

U.S. Pat. No. 3,203,689 discloses a refractory lined tundish with one or more ceramic shell liners of the same density placed therein.

An expendable tundish liner is shown in my prior U.S. Pat. No. 3,955,721.

The present invention comprises a combination metal trough, insulating material and an expendible liner therefor formed of several layers of refractory material of different densities and having a predetermined wear factor so that the lift of the liner and its wear can be observed visually.

SUMMARY OF THE INVENTION

A blast furnace hot metal trough and expendable liner therefor uses a relatively thin metal trough and a rigid one-piece multiple layered refractory liner with insulating and cushioning material therebetween. The expendable liner is shaped to conform to the interior of the hot metal trough and is molded by ramming refractory base materials into different densities in successive layers in a suitable shaped mold. The liner is then dried and/or baked prior to use.

DESCRIPTION OF THE PREFERRED EMBODIMENT

Figure 1:
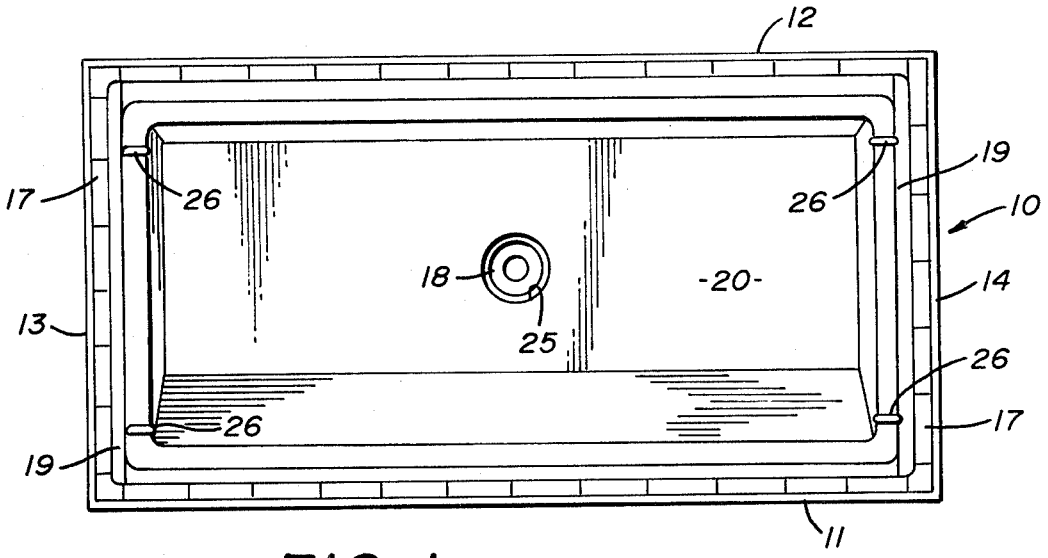
FIG. 1 is a top plan view of the combination blast furnace and liner combination.
Figure 2:
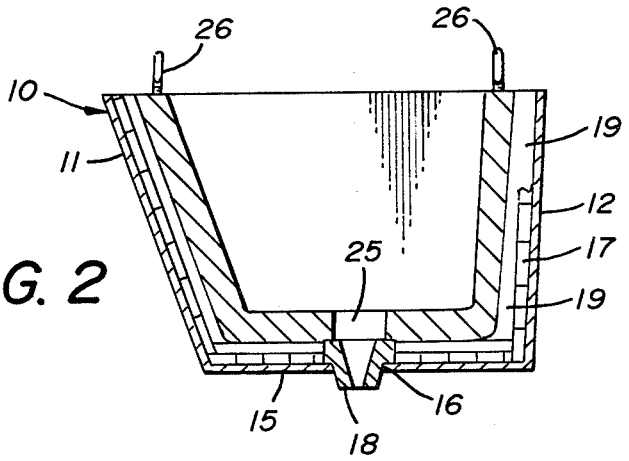
FIG. 2 is a cross section on line 2—2 of FIG. 1.

By referring to FIGS. 1 and 2 of the drawings, it will be seen that a metal blast furnace trough 10 has front and back walls 11 and 12, end walls 13 and 14 and an integral bottom 15. The bottom 15 is apertured as at 16 and refractory bricks 17 line the inside of the metal trough 10. A refractory nozzle 18 is located in the aperture 16. Cushioning and insulating slabs 19 formed of dolomite, sawdust and sodium silicate and/or similar materials are positioned on the refractory bricks 17 and form a yieldable support for an expendable one-piece refractory shell 20 which completes the combination.

The refractory shell 20 is shaped to fit in the device where it forms a ceramic liner spaced from the metal trough 10 by the refractory bricks 17 and the insulating and cushioning slabs 19. The cushioning and insulating slabs 19 are preferably formed of the hot top material disclosed in my U.S. Pat. No. 3,212,749, namely dolomite, sawdust and sodium silicate in a mixture consisting essentially of about 15% by weight of sawdust, about 54% by weight of dolomite, and about 31% by weight of sodium silicate. The mixture may be altered by substituting consumable ingredients for the sawdust, such as paper pulp, wood chips, rice hulls, wheat kernals or the like, and substitutes for the dolomite may comprise sand, granulated slag, or powdered fired clay and an alternate for the sodium silicate may comprise resin urea formaldehyde. The use of consumable materials in the slabs 19 of cushioning and insulating material enables the same to provide additional heat which is advantageous in maintaining the molten metal in the blast furnace trough and liner combination as will occur to those skilled in the art. The refractory bricks 17 may be eliminated from the device of the invention by increasing the thickness of the slabs 19 as shown in the broken away modification illustrated in the upper right hand portion of FIG. 2. In either form of the invention, the expendable refractory shell 20 is easily removed and replaced so that the device of the invention can be used more or less continuously.

Figure 4:
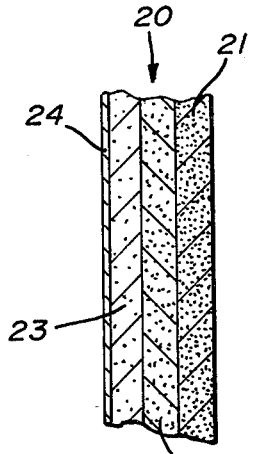
FIG. 4 is an enlarged section of part of the liner illustrating the different densities thereof.

The expendable refractory shell 20 is formed in the desired shape to become part of the novel combination by ramming and compacting refractory material into a mold of the desired configuration and the formation of the refractory shell 20 is accomplished by forming multiple layers of the refractory material in different densities as illustrated in an enlarged cross sectional detail of FIG. 4 of the drawings wherein the outermost layer 21 is very dense, the intermediate layer 22 of lesser density and the innermost layer 23 of still lesser density.

In FIG. 4 of the drawings, the innermost surface of the inner layer 23 of the refractory shell 20 is shown provided with a penetrating coating of micron or submicron sized graphite particles in a suitable carrier which comprises water, an aqueous sodium silicate solution and hydrchloric acid along with a water soluable resin of the carboxyl group of carboxylic acids and the like. A typical desirable ingredient may comprise carboxy polymethylene polymer which is a dry fluffy acid powder which can be power mixed with the micron or submicron sized graphite particles in the liquid carrier to obtain a suitable hydrogen bonding in the solution. A typical penetrating and lubricating adhesive coating comprises substantially between about 5% to 25% by weight micron or submicron sized particles of graphite, between about 34% to 75% by weight of a solution of water and sodium silicate wherein the sodium silicate is present at about 40% of the solution by weight, between about 2% and 10% concentrated hydrochloric acid of a 90% purity by weight and between about 33% to 75% of a solution of water and carboxy polymethylene polymer resin wherein the resin is present in amounts between 1% and 10% of the solution by weight. The expendable multi-layered refractory shell 20 is apertured as at 25 in registry with the nozzle 18 heretofore referred to. Preferably the eye bolts 26 embedded in the uppermost edge of the refractory shell 20 and they may be manually engaged therein by molding preformed ceramic inserts having threaded bores therein into the upper edge of the ceramic shell 20 so that the eye bolts 26 can be threadably engaged in the finished product to provide a convenient means for handling the same.

Figure 3:
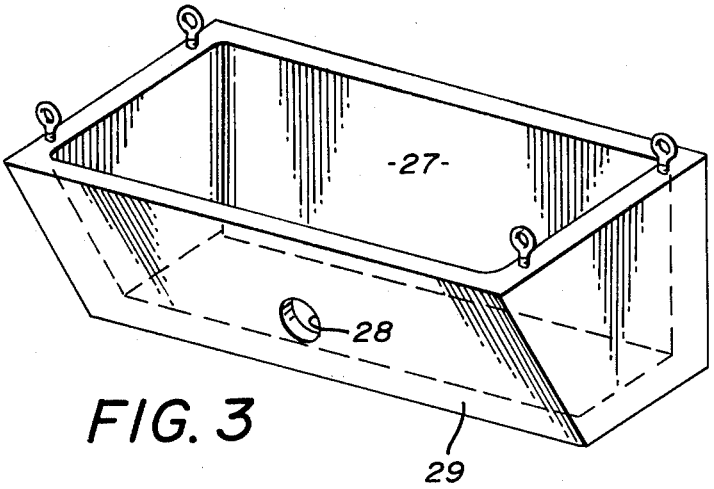
FIG. 3 is a perspective view of an alternate form of the blast furnace trough and liner combination.

In FIG. 3 of the drawings, an alternate construction is disclosed with respect to the orifice through which the hot metal is delivered from the blast furnace trough and liner device. In FIG. 3 of the drawings, the expendable refractory shell is illustrated at 27 with an aperture 28 in a front wall 29 thereof. Those skilled in the art will observe that the device of the invention is usable both as a blast furnace trough and as a pouring receptacle or the like in connection with a continuous caster, the only difference in the structure being the location of the aperture through which the hot metal flows and it will thus be seen that the device of the invention can be used in connection with prefabricated hot metal runners by positioning the same adjacent to one end of an assembly thereof or on one end of an assembly thereon and in either case adjacent the pouring orifice of the source of the hot metal and that alternately when the device is positioned on a continuous caster, the metal may flow through an orifice in the bottom of the device or if some non-metallic inclusions exist in the metal, the form of the device having the aperture in a front wall thereof can be used to take advantage of the tundish effect of separating the non-metallic inclusions from the hot metal being handled. The refractory material from which the expendable ceramic shell is made in the several layers of different densities advantageously takes the form of 81½% by weight Mulcoa brand aluminum oxide which is a mixture having 60% pure aluminum oxide, 13½% raw fire clay and 5% pure aluminum oxide (Al O). This is mixed with a phosphoric acid solution which is 50% water and 50% phosphoric acid in a ratio to the other ingredients of 1.14 to 1.

In the present example 88 pounds of phosphoric acid solution is added to 100 pounds of the above combined materials to produce a slurry suitable to be rammed or packed into a suitably shaped mold to form the expendable ceramic shell. The formed shell is then dried and/or baked to a desired moisture free state and then coated with the graphite particle coating hereinbefore described.

It will thus be seen that the blast furnace trough and liner combination disclosed herein has the additional advantage of providing a heat retaining structure so that the device of the invention delivers the molten metal with a very small loss of heat and which contributes to the rapid flow of molten metal without significant loss of temperature as otherwise occurs. Monolithic construction of the expendable refractory shell 20 in multiple layers of different densities of material enables the same to be easily removed and discarded when the indication of excessive wear is visually observed. This enables a new expendible ceramic shell liner 20 to be quickly and easily installed with or without the replacement of the cushioning and insulating slabs 19 as the case may be and which condition is also readily determined by visual observation.

Practically, the device of the invention is examined between pourings of hot metal therethrough and when indication of excess wear is visible the expendable ceramic shell liner is quickly and easily removed and the insulating slabs 19 also removed and replaced whereupon a new and expandable refractory shell 20 is installed and the blast furnace trough and liner combination is immediately available for a further pour of hot metal.

It will thus be seen that a blast furnace trough and liner combination has been disclosed which is capable of saving considerable labor expense and time in a hot metal pouring operation as the heretofore believed necessary relining of comparable devices with refractory clay and brick is completely eliminated.

Although but two embodiments of the present invention have been illustrated and described, it will be apparent to those skilled in the art that various changes and modifications may be made therein without departing from the spirit of the invention and having thus described my invention what I claim is:

1. An improvement in a blast furnace trough and liner combination for handling hot metal, the improvement comprising a replaceable and expendable liner and cushioning and insulating means supporting the same, said blast furnace trough including an open topped apertured metallic vessel, said replaceable and expendable liner comprising a multi-layered mass coalesced by physical force with each of said multi-layers being of a different density and having a known predetermined lifetime when subjected to molten metal flowing thereover.

2. The improvement in the blast furnace trough and liner combination of claim 1 wherein said liner is formed of refractory material selected from those usable for fire bricks.

3. The improvement in the blast furnace trough and liner combination of claim 1 wherein said liner is formed of clay.

4. The improvement in the blast furnace trough and liner combination of claim 1 wherein the mass of the liner is formed progressively of several layers, each compacted to a different degree of density.

5. The improvement in the blast furnace trough and liner combination of claim 1 wherein the mass of the liner is formed progressively of several layers, each compacted to a different degree of density and thickness.

6. The improvement in the blast furnace trough and liner combination of claim 1 wherein a graphite coating is penetrated into the metal receiving areas of said liner and the graphite is applied as a subcolloidal particle size in a liquid carrier.

7. The improvement in the blast furnace trough and liner combination of claim 1 wherein said cushioning and insulating means consists of at least one layer of a consumable mixture consisting essentially of about 15% by weight of a combustible material, about 54% by weight of a heat disintegratable material and about 31% by weight of a liquid binder.

8. The improvement in the blast furnace trough and liner combination of claim 1 wherein said cushioning and insulating means consists of at least one thickness of a consumable mixture consisting essentially of about 15% by weight sawdust, about 54% by weight dolomite, and about 31% by weight of sodium silicate.

9. An improvement in a blast furnace trough and liner combination for handling molten metal, the improvement comprising a replaceable and expendable liner, said blast furnace trough including an open topped apertured metallic vessel, said replaceable and expendable liner comprising a mass coalesced by physical force of a size to fit within said metallic vessel.

10. The improvement in a blast furnace trough and liner combination of claim 9 and wherein said liner is formed of refractory material selected from those usable for fire bricks.

* * * * *